US010287789B2

(12) United States Patent
McLoughlin et al.

(10) Patent No.: US 10,287,789 B2
(45) Date of Patent: May 14, 2019

(54) HOTEL ROOMS

(71) Applicant: Six Continents Hotels, Inc., Atlanta, GA (US)

(72) Inventors: Andrew James McLoughlin, Henley-on-Thames (GB); Timothy Robert Jones, Adderbury (GB); Richard Matthew Booth, Olney (GB); David Alexander Hamilton, London (GB)

(73) Assignee: SIX CONTINENTS HOTELS, INC., Atlanta, GA (US)

( * ) Notice: Subject to any disclaimer, the term of this patent is extended or adjusted under 35 U.S.C. 154(b) by 688 days.

(21) Appl. No.: 14/563,248

(22) Filed: Dec. 8, 2014

(65) Prior Publication Data

US 2015/0089890 A1 Apr. 2, 2015

Related U.S. Application Data

(62) Division of application No. 13/647,181, filed on Oct. 8, 2012, now abandoned.

(51) Int. Cl.

| | |
|---|---|
| ***E04D 13/18*** | (2018.01) |
| ***E04H 3/02*** | (2006.01) |
| ***A47B 13/00*** | (2006.01) |
| ***A47C 17/00*** | (2006.01) |

(52) U.S. Cl.

CPC ..... *E04H 3/02* (2013.01); *A47B 13/00* (2013.01); *A47C 17/00* (2013.01)

(58) Field of Classification Search

CPC ..... E04F 13/081; E04F 13/083; E04F 17/08

USPC ..... 52/173.1, 220.7, 36.1, 35

See application file for complete search history.

(56) References Cited

U.S. PATENT DOCUMENTS

| | | | | |
|---|---|---|---|---|
| 3,195,191 | A * | 7/1965 | Neisewander | 52/243.1 |
| 3,952,465 | A * | 4/1976 | Masiello | 52/73 |
| 4,127,971 | A | 12/1978 | Rojo et al. | |
| 4,341,052 | A | 7/1982 | Douglass et al. | |

(Continued)

FOREIGN PATENT DOCUMENTS

| | | |
|---|---|---|
| CN | 101169003 | 4/2008 |
| CN | 102396917 | 4/2012 |

(Continued)

OTHER PUBLICATIONS

U.S. Appl. No. 13/647,181 , "Final Office Action", dated Dec. 24, 2013, 8 pages.

(Continued)

*Primary Examiner* — Basil S Katcheves

(74) *Attorney, Agent, or Firm* — Kilpatrick Townsend & Stockton LLP

(57) ABSTRACT

An improved hotel configuration. The hotel room configuration includes two adjacent rooms, one of which forms a T, and the other of which forms an L, with the base of the T fitting into the right angle formed by the L. Embodiments are directed to reconfiguring an existing hotel having adjacent, side-by-side rooms into the T and L configuration. Additional embodiments are directed to a combined television stand and desk module that fits into or is used as a footboard of a bed. A television can be mounted on the top of this console, and can, in embodiments, rotate to face the desk, the bed, or other parts of the room.

15 Claims, 8 Drawing Sheets

(56) References Cited

U.S. PATENT DOCUMENTS

| | | | | |
|---|---|---|---|---|
| 4,655,011 | A * | 4/1987 | Borges | 52/79.1 |
| 4,685,255 | A * | 8/1987 | Kelley | 52/36.1 |
| 4,744,182 | A | 5/1988 | Shacket et al. | |
| 5,111,626 | A | 5/1992 | Fortune et al. | |
| 5,321,579 | A * | 6/1994 | Brown et al. | 361/679.06 |
| 5,398,195 | A | 3/1995 | Kim et al. | |
| 5,642,593 | A * | 7/1997 | Shieh | 52/239 |
| 5,815,987 | A | 10/1998 | Beasley et al. | |
| 6,243,993 | B1 | 6/2001 | Swensson | |
| 6,256,936 | B1 * | 7/2001 | Swensson et al. | 52/35 |
| 6,393,774 | B1 * | 5/2002 | Fisher | 52/79.1 |
| 6,851,226 | B2 * | 2/2005 | MacGregor et al. | 52/36.1 |
| 6,922,960 | B2 | 8/2005 | Sataka et al. | |
| 6,996,940 | B2 | 2/2006 | Beasley et al. | |
| 7,174,678 | B2 * | 2/2007 | Gallant | 52/36.1 |
| D561,910 | S | 2/2008 | Wagemans | |
| D641,494 | S | 7/2011 | Wagemans et al. | |
| 8,033,067 | B2 | 10/2011 | Miller et al. | |
| 8,402,700 | B2 * | 3/2013 | Hall et al. | 52/67 |
| 8,720,137 | B2 * | 5/2014 | Love | 52/220.1 |
| 2002/0189173 | A1 * | 12/2002 | Staschik | 52/79.1 |
| 2003/0182884 | A1 * | 10/2003 | Kishimoto et al. | 52/238.1 |
| 2003/0205022 | A1 * | 11/2003 | Mawby et al. | 52/745.02 |
| 2003/0226323 | A1 * | 12/2003 | Travez et al. | 52/220.7 |
| 2004/0103593 | A1 * | 6/2004 | Beasley | 52/64 |
| 2005/0091936 | A1 * | 5/2005 | Galloway et al. | 52/287.1 |
| 2006/0277838 | A1 | 12/2006 | Travez et al. | |
| 2008/0126022 | A1 | 5/2008 | Hoguet et al. | |
| 2008/0270085 | A1 | 10/2008 | Stone et al. | |
| 2009/0223143 | A1 * | 9/2009 | Esposito | 52/79.1 |
| 2010/0024330 | A1 | 2/2010 | Sodaro et al. | |
| 2011/0099918 | A1 * | 5/2011 | Buchmann | 52/79.1 |
| 2011/0179721 | A1 * | 7/2011 | Barry et al. | 52/79.1 |
| 2011/0218777 | A1 | 9/2011 | Chen et al. | |
| 2014/0096461 | A1 | 4/2014 | McLoughlin et al. | |

FOREIGN PATENT DOCUMENTS

| | | |
|---|---|---|
| CN | 202194406 | 4/2012 |
| DE | 20318195 | 4/2004 |
| EA | 14698 | 12/2010 |
| GB | 108747 | 8/1917 |
| JP | 6073971 | 4/1985 |
| JP | 2001132252 | 5/2001 |
| JP | 2002000372 | 1/2002 |
| JP | 2004316218 | 11/2004 |
| JP | 2004353416 | 12/2004 |
| JP | 2005133422 | 5/2005 |
| JP | 2007197917 | 8/2007 |
| JP | 2007214924 | 8/2007 |
| JP | 3137478 | 10/2007 |
| JP | 3141023 | 3/2008 |
| JP | 2008280705 | 11/2008 |
| WO | 2009012801 | 1/2009 |

OTHER PUBLICATIONS

U.S. Appl. No. 13/647,181 , "Non-Final Office Action", dated May 17, 2013, 7 pages.
AU2013234431 , "First Examiner Report", dated Apr. 7, 2015, 3 pages.
JP2013-209922 , "Office Action", dated Sep. 30, 2014, 10 Pages.
RU2013144920 , "Office Action", dated Feb. 19, 2015, 6 pages.
Installation of KNAUF 8-495-744-62-45 Composite Systems. [online] Dec. 6, 2011. Retrieved from the Internet: <URL: http://www.gipsmontaj-st.ru/vse-ogipsokartonnich-rabotach/mezhkomnatnie-peregorodki>.
Room Partitions in the Interior. [online] Sep. 26, 2012. Retrieved from the Internet: <URL: http://www.kvartira-box.ru/272-komnatnye-peregorodki-v-interere.html>.
Reorganization and re-planning of leaving rooms. *The Housing Code of the Russian Federation*, Chapter 4 (2004).
CN201310607617.5 , "Office Action", dated Jun. 8, 2015, 19 pages.
JP2013-209922 , "Office Action", dated Jun. 30, 2015, 7 pages.
CA2829081, "Office Action," dated Sep. 4, 2015, 3 pages.
RU2013144920, "Official Action," dated Sep. 19, 2015, 6 pages.
CA2,829,081, "Office Action", dated Jul. 18, 2016, 4 pages.
JP2013-209922, "Office Action," dated Feb. 8, 2016, 4 pages.
MX/A/2013/011644, "Office Action," dated Dec. 9, 2015, 3 pages.
MX/A/2013/011644, "Office Action," dated Jun. 7, 2016, 4 pages.
MX/A/2013/011644, "Office Action," dated Jan. 13, 2017, 4 pages.
RU2013144920, "Notice of Decision to Grant," dated Dec. 3, 2015, 13 pages.
EP13187597.3 , "Partial European Search Report", dated Aug. 17, 2017, 7 pages.
JP2013-209922 , "Office Action", dated Aug. 7, 2017, 21 pages.
CA2829081, "Office Action," dated May 26, 2017, 6 pages.
MXMX/A/2013/011644, "Office Action," dated Jun. 13, 2017, 5 pages.
EP13187597.3, Extended European Search Report, dated Nov. 22, 2017, 11 pages.
IN4530/CHE/2013 , "First Examination Report", dated Dec. 3, 2018, 6 pages.

* cited by examiner

HOTEL ROOMS

This application is divisional application of, and claims priority to, U.S. patent application Ser. No. 13/647,181, filed Oct. 8, 2012, and titled "Hotel Rooms", the content of which is hereby incorporated by reference in its entirety.

BACKGROUND

A hotel is an establishment that provides paid lodging on a short term basis. Hotels typically consist of a single or multiple buildings having multiple rooms in each building. Each room includes a bed, a bathroom, and many modern conveniences, such as a telephone, an alarm clock, a television, a safe, a mini-bar, and other amenities.

Common features found in hotel rooms are a telephone, an alarm clock, a television, a safe, a mini-bar with snack foods and drinks, and facilities for making tea and coffee. Luxury features include bathrobes and slippers, a pillow menu, twin-sink vanities, and jacuzzi bathtubs. However, despite these features, if a room is shared with another individual, that hotel room can feel crowded, especially if one guest is trying to sleep while the other guest is watching television, working, or reading.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to an improved hotel configuration. The hotel room configuration includes two adjacent rooms, one of which forms a T, and the other of which forms an L, with the base of the T fitting into the right angle formed by the L.

Embodiments are directed to reconfiguring an existing hotel having adjacent, side-by-side rooms into the T and L configuration. In addition, new construction may include such a configuration.

Additional embodiments are directed to a combined television stand and desk module that fits into or is used as a footboard of a bed. A television can be mounted on the top of this console, and can, in embodiments, rotate to face the desk, the bed, or other parts of the room. The desk is movable away from the console so that it may be positioned against the console and parallel to the console, so that the console is used as a back to the desk, or such that the desk is perpendicular to the console, wherein two chairs may be positioned on opposite sides of the desk for eating, for example.

Additional embodiments are directed to a sleeping area having multiple different features for aiding in a guest falling asleep and/or a guest sleeping while another guest is awake. These comforts include a cushioned headrest, permitting a guest to lean against the head rest while watching a television, for example. A replaceable linen may be provided for the back of the headrest. The headrest may include passive and/or active sound-absorbing materials so as to provide a quieter experience for a guest.

In embodiments, the headrest may also include noise-cancelling technologies and/or lights that are particularly directed to opposite sides of the bed, so as to provide privacy for individuals on opposite sides of the bed.

In additional embodiments, the sleeping area is provided with a control panel for controlling sound, lights and individual vents for opposite sides of the bed. The control panel may be mounted on the control center, which includes a phone, a cup holder, induction charging, chargers, and so forth.

Embodiments are directed to a method a retrofitting a hotel, the hotel comprising a pair of structural walls with two rooms defined between the structural walls, and a dividing wall separating the two rooms, the method comprising: removing the dividing wall; and replacing the dividing wall with a structure that separates the space into two new rooms and defines separate spaces in each of the two new rooms.

The dividing wall can be a straight wall. In embodiments, the two new rooms are shaped like a T and L, respectively. In addition, in embodiments, the structure is an S shaped wall.

Embodiments are also directed to a hotel, the hotel having a first structural wall; a second structural wall; a space defined between the first and second structural walls; and a dividing wall with a structure that separates the space into two rooms and defines separate spaces in each of the two rooms. The two rooms can be shaped like an L and a T, respectively. The L-shaped room can include a sitting area at the lower portion of the L, and a sleeping portion in the main part of the L.

The hotel in embodiments includes a bed in at least one of the rooms; and a console at a foot of the bed, the console comprising a rotating television stand that is viewable from the bed and from the separate spaces in the rooms. The desk in embodiments is configurable between a first configuration in which the desk extends parallel to the console and a second configuration in which the desk is perpendicular to the console and can be used as a table so chairs can be positioned on opposite sides of the desk.

Additional embodiments are directed to a hotel room, including a bed in the room; a console at the foot of the bed; a television rotatably mounted on the console; and a desk positioned adjacent to the console. In further embodiments, the desk is configurable between a first configuration that the desk extends parallel to the console and a second configuration in which the desk is perpendicular to the console and can be used as a table on opposite sides of the desk.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to an improved hotel configuration. The hotel room configuration includes two adjacent rooms, one of which forms a T, and the other of which forms an L, with the base of the T fitting into the right angle formed by the L.

Embodiments are directed to reconfiguring an existing hotel having adjacent, side-by-side rooms into the T and L configuration. In addition, new construction may include such a configuration.

Additional embodiments are directed to a combined television stand and desk module that fits into or is used as a footboard of a bed. A television can be mounted on the top of this console, and can, in embodiments, rotate to face the desk, the bed, or other parts of the room. The desk is movable away from the console so that it may be positioned against the console and parallel to the console, so that the console is used as a back to the desk, or such that the desk is perpendicular to the console, wherein two chairs may be positioned on opposite sides of the desk for eating, for example.

Additional embodiments are directed to a sleeping area having multiple different features for aiding in a guest falling asleep and/or a guest sleeping while another guest is awake. These comforts include a cushioned headrest, permitting a guest to lean against the head rest while watching a television, for example. A replaceable linen may be provided for the back of the headrest. The headrest may include passive and/or active sound-absorbing materials so as to provide a quieter experience for a guest.

In embodiments, the headrest may also include noise-cancelling technologies and/or lights that are particularly directed to opposite sides of the bed, so as to provide privacy for individuals on opposite sides of the bed.

In additional embodiments, the sleeping area is provided with a control panel for controlling sound, lights and individual vents for opposite sides of the bed. The control panel may be mounted on the control center, which includes a phone, a cup holder, induction charging, chargers, and so forth.

Figure 1:
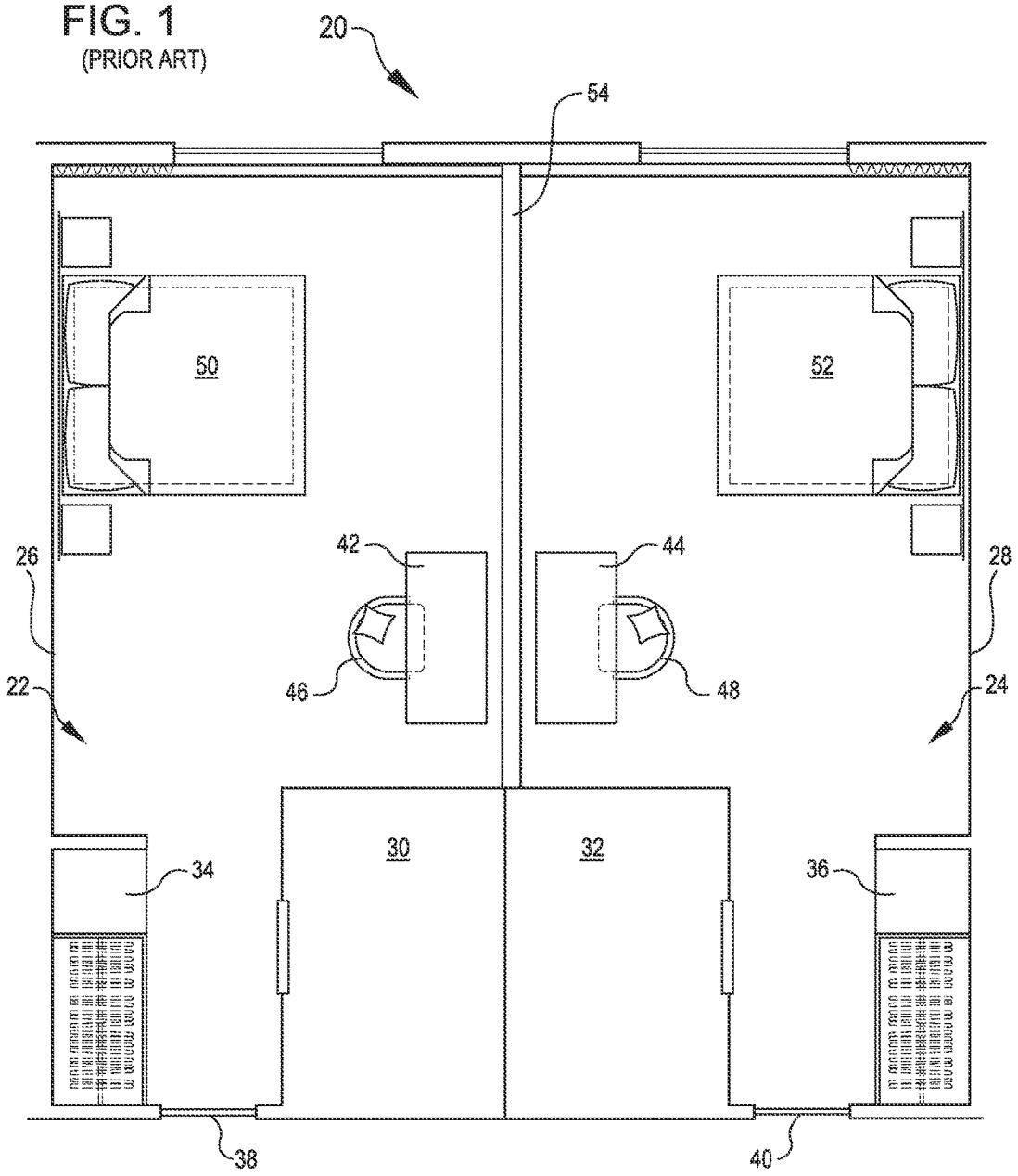
FIG. 1 (PRIOR ART)
FIG. 1 is a top diagrammatic view representing a prior art room configuration.

Referring now to the drawings, in which like reference numerals represent like figures throughout the several views, FIG. 1 shows a prior art room configuration 20. The prior art room configuration 20 includes a left room 22 and a right room 24. A left supporting wall 26 runs along the left side of the left room 22, and a right supporting wall 28 runs along the right side of the right room 24.

Back-to-back bathrooms 30, 32 are provided for the left room 22 and the right room 24, respectively. Closets 34, 36 are positioned opposite the bathrooms, and lobby areas are formed between the closets and the bathrooms. Doorways 38, 40 are positioned to enter the lobby areas.

In embodiments, the left room 22 and the right room 24 include desks 42, 44, chairs 46, 48, and beds 50, 52. In the embodiments shown in the drawing, these beds and desks are positioned in a conventional way, with the desk and the headboard of the bed positioned against the same wall.

In the prior art room configuration 20 shown in FIG. 1, a straight wall 54 extends between and divides the left and right rooms 22, 24. This straight wall 54 is typically not a supporting wall, but instead is provided to structurally divide the two rooms into separate spaces.

For the prior art room configuration 20 shown, the bathrooms 30, 32 are positioned back-to-back and the closets are positioned at the doorways 38, 40. Alternate configurations are often used in prior art hotel structures, but generally include structural walls defining a large space between which two rooms are defined. A single, straight wall, such as the wall 54 shown in FIG. 1, is provided to divide the space into two rooms. A problem with this configuration is that the two rooms that are formed are generally rectangles. Rectangular rooms provide a very good structure for making a room look large, but do not necessarily define separate spaces. In addition, a bulk of the room is dead space in the middle of the room, and the overall rectangular shape of the room does not lend well to segregation between two guests, especially if one is trying to sleep and the other is not.

Figure 2:
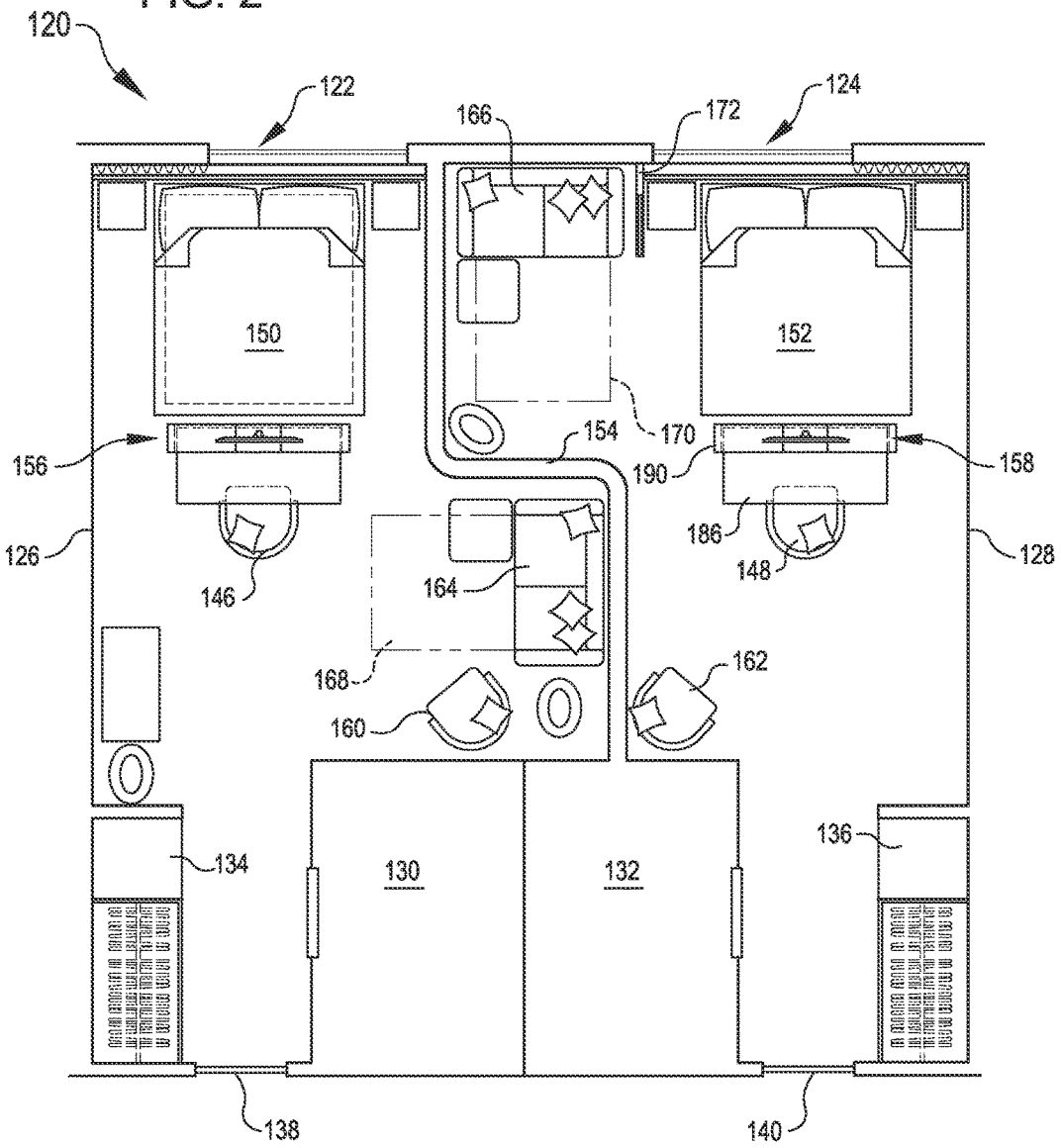
FIG. 2 is a top diagrammatic view of the room of FIG. 1 after retrofitting, in accordance with embodiments.

FIG. 2 is a top view representation of the room configuration 20 of FIG. 1 after a reconfiguration to a revised room configuration 120. The room configuration 120 in FIG. 2 is structurally mostly the same as the room configuration 20 in FIG. 1. To this end, reference numerals used in FIG. 2 represent like parts to items in FIG. 1, with the numeral 100 added to the reference numerals in FIG. 1 to represent like or identical features in FIG. 2. For example, the bathrooms 30, 32 of FIG. 1 are represented by the reference numerals 130, 132 in FIG. 2.

In FIG. 2, the straight wall 54 has been removed and replaced with an S-shaped wall 154. In embodiments, like the straight wall 54, the S-shaped wall 154 is not structural. In accordance with one embodiment, the prior art room configuration 20 is reconfigured by removal of the straight wall 54 and replacement of that straight wall with the S-shaped wall 154. In alternate embodiments, a room configuration, such as the room configuration 120, may be formed during initial construction of a hotel building. In such a configuration, the S-shaped wall 154 may be structural or not.

The S-shaped wall 154 provides an advantage over the straight wall 54 of the prior art room configuration 20. As can be seen in FIG. 2, the two adjacent left and right rooms 122, 124 have different shapes. The left room 122 is a T shape, with the base of the T forming a seating area or living zone. This living zone or seating area is separate from a sleeping zone where a bed 150 can be positioned. The right room 124 is L-shaped and includes a living or seating zone that is separate from a sleeping zone. The living zone is formed in the base of the L.

In embodiments, to take advantage of the L and T shapes, 150, 152 is positioned at that end of the rooms 122, 124, with the headboard positioned underneath a window. In addition, a special desk and console 156, 158 are positioned at the foot of the bed 150, 152. The desk and console 156, 158 are described in more detail below.

The rooms 122, 124 include a second chair 160, 162 or a stool (not shown). In addition, in accordance with embodiments, a sofa or sofa 164, 166 may be provided in each of the seating/living zones of the rooms 122, 124. For example, as shown in FIG. 2, the sofa 164 is positioned with its back against the base of the T. In embodiments, the sofa 164 may include a foldout bed 168, shown in phantom lines, which may be used when additional guests are staying in the room 122.

Figure 5:
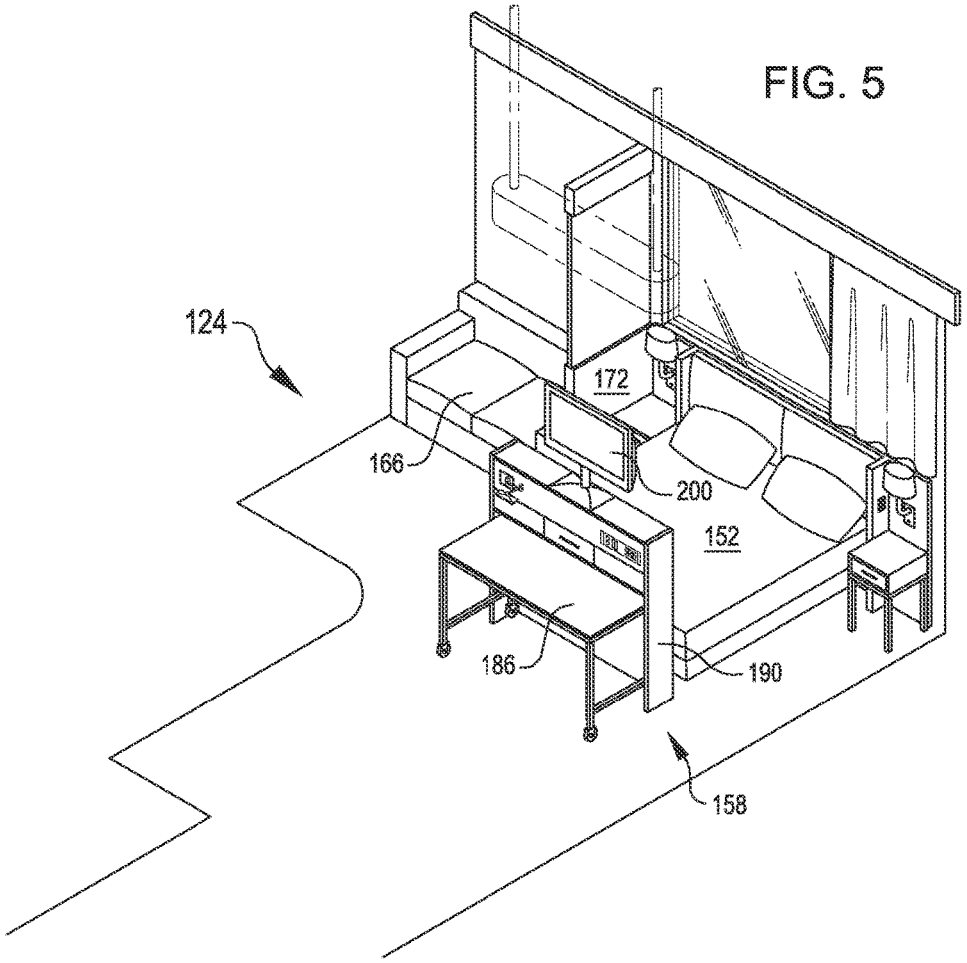
FIG. 5 is a side perspective view of a sleeping area and a sitting area for the room of FIG. 3.
Figure 6:
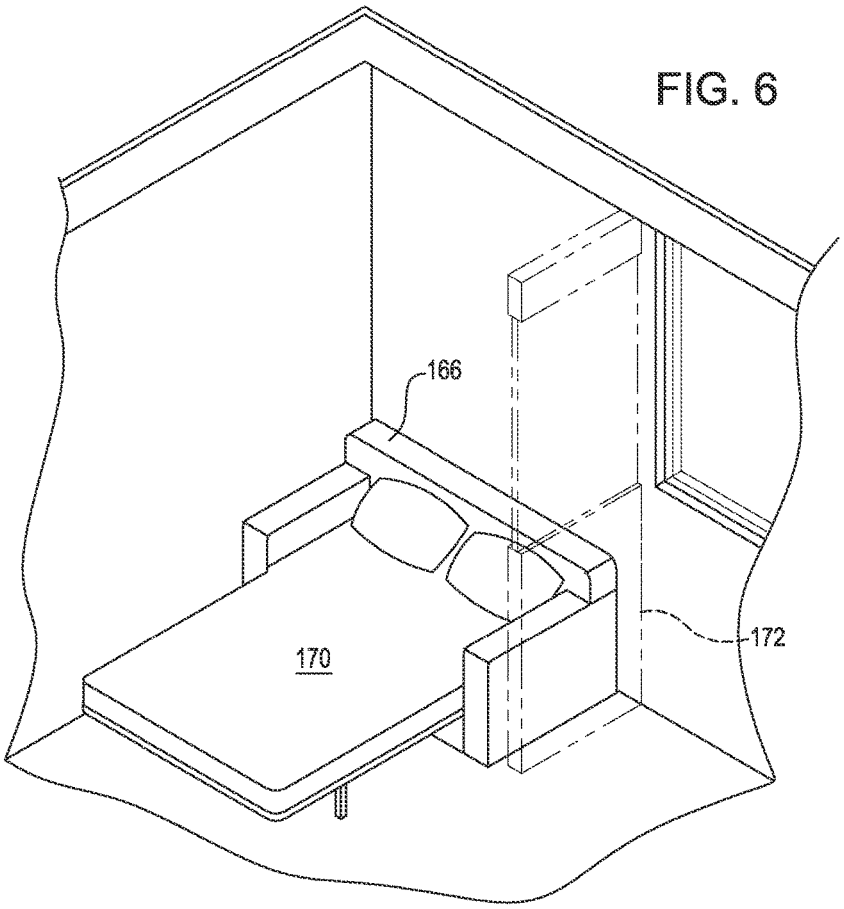
FIG. 6 is a side perspective view of the sitting area of FIG. 5, with a pull-out bed shown exposed.

For the right room 124, the sofa 166 is positioned with its back against the same wall that the headboard of the bed is positioned. This sofa 166 may also include a foldout bed 170. To provide privacy between the bed 152 and the sofa 166/foldout bed 170, a separator wall 172 can be provided between these areas. The separator wall 172 is better shown in FIG. 5.

The L and T configurations described above provide separate seating/living space and sleeping spaces for a hotel guest or guests. This feature permits two guests to stay in the same room, but be separated from one another into different sections of the room. To this end, both the T and L shaped rooms define separate areas within the rooms that are isolated from a sleeping area. A T shaped room defines three areas, with one at each arm of the top of the T, and one at the base. An L defines a main room area with a side room area. One of these spaces may be separately furnished and isolated from other spaces. For example, one guest may be in the bed, while the others may be sitting on the sofa watching TV or working on a project, and these two individuals sit in separate "rooms" or areas from one another, and these areas may be separately lighted, or sound or pictures (e.g., via a television or computer) may be confined within one of the areas and limited to another. In addition, without requiring additional space over the prior art room configuration 20 shown in FIG. 1, the room configuration 122 shown in FIG. 2 provides more comfort and the perception of more space.

Configurations other than the L-T configuration described above may be used, but in general, a straight wall is replaced with one or more walls that create separate spaces in each of the rooms. A jagged tooth wall may be used to define multiple spaces in each room. Diagonal, rounded, or other walls can define interesting spaces. Generally, a wall dividing the two rooms will result in two rooms that are roughly the same size, but in embodiments, one can be larger than the other.

Figure 3:
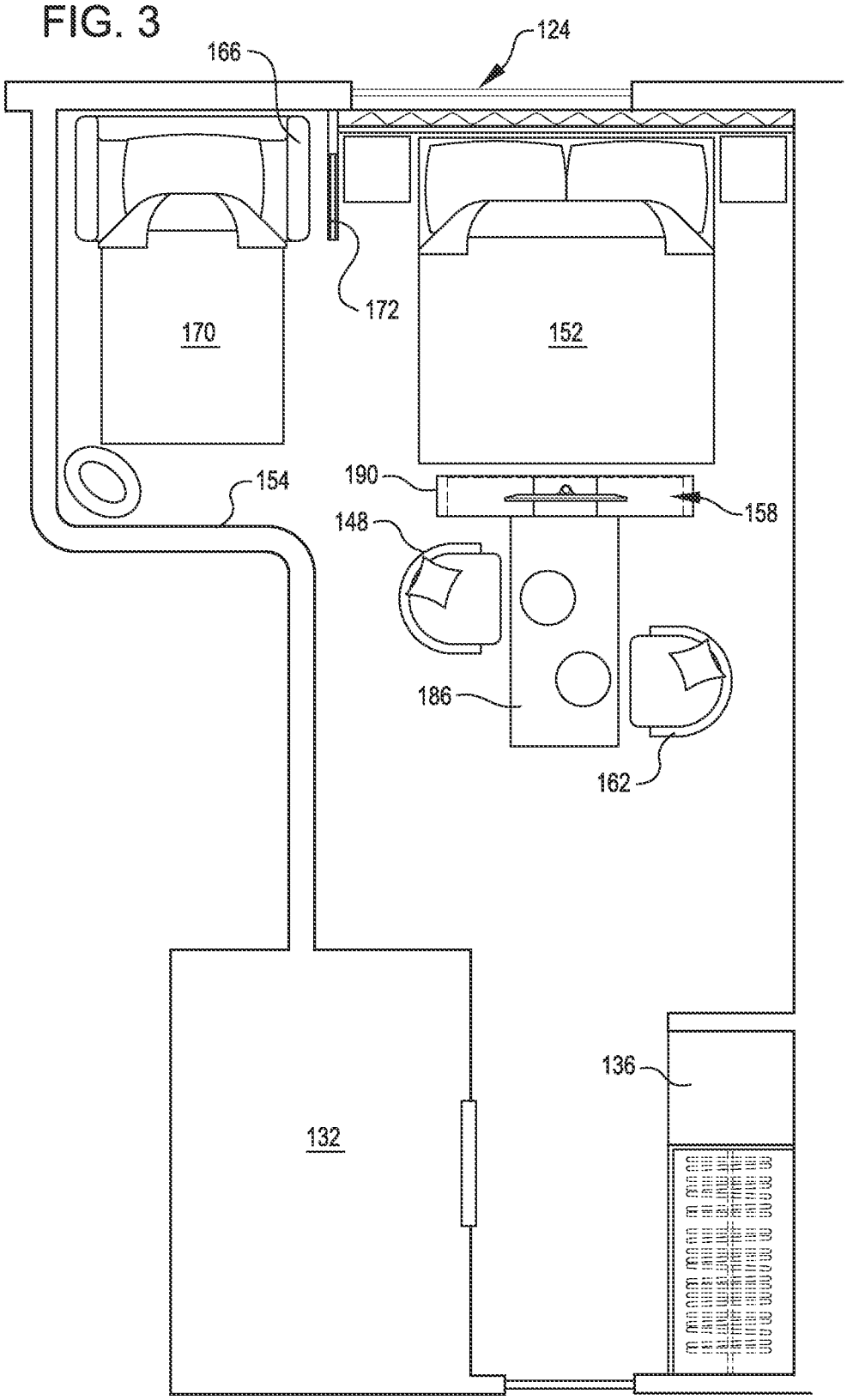
FIG. 3 is a top diagrammatic view of a right room for the room configuration of FIG. 2, with a desk reconfigured to a table configuration in accordance with embodiments.
Figure 4:
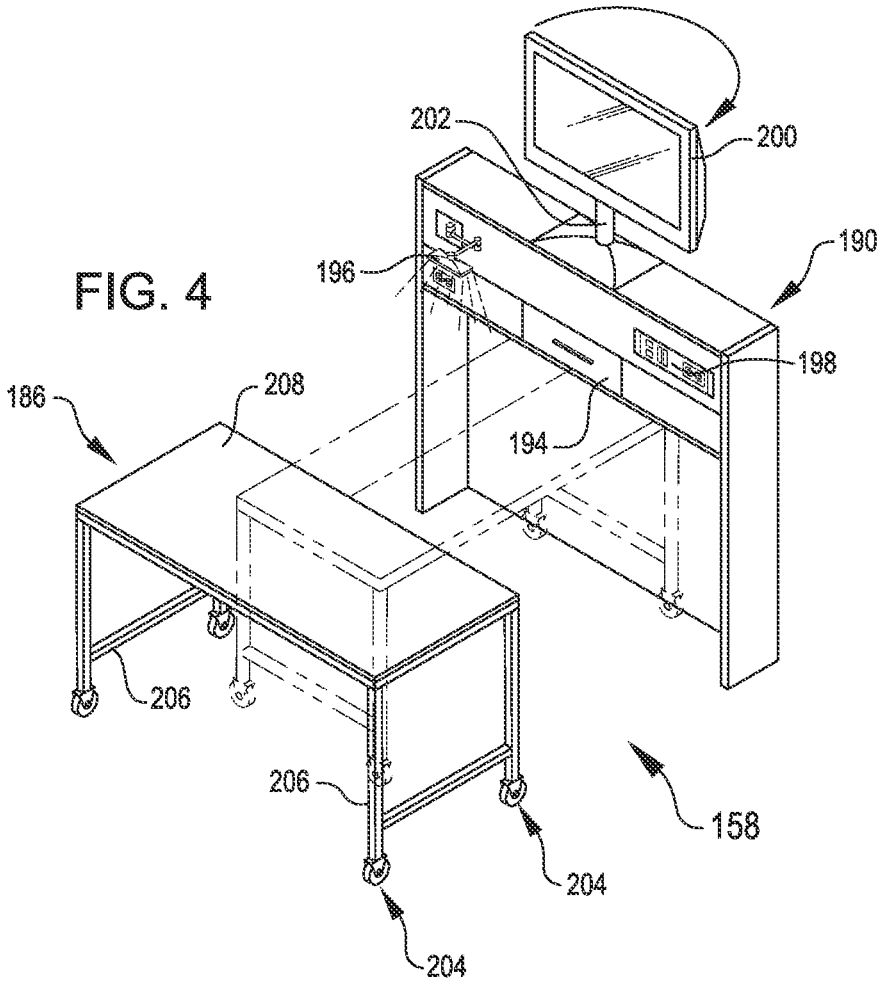
FIG. 4 is a side perspective view of a desk and module combination that can be used with the room of FIG. 3 in accordance with embodiments.

Details of an embodiment of a desk and console 156 that can be used with the L and T rooms 122, 124 in accordance with embodiments are shown in FIGS. 3 and 4. The desk and console 156 includes a desk 186 that can be positioned against a separate console 190. In the embodiments shown in the drawing, the console 190 serves a footboard for one of the beds, such as the bed 150. To this end, the console 190 may be attached to the end of the bed 150, or may be positioned against the end of the bed. The console 190 shown in the drawing includes a drawer 194, a desk light 196, and a media hub 198, although different and/or additional features can be provided. The media hub 198 may include, for example, sockets for TV and media connectivity, or other features. A television 200 is mounted on the top of the console 190. In embodiments, the television 200 includes a swivel base 202.

In the embodiments shown in the drawing, the desk 186 includes wheels 204 connected to the bottom of legs 206. A table top 208 is positioned on top of the legs 206. As shown in FIG. 2, the desk 186 may be configured so that it may be fit partially into the console 190 in a first configuration. In this first configuration, the desk 186 extends parallel to the console 190. In this configuration, the desk 186 can be used as a desktop working surface, for example, for receiving a laptop or other computer. A guest may sit in the chair 146 and work at the desk 186 or watch the television 200. Power is provided to the media hub 198 for a laptop or other devices.

In accordance with embodiments, as shown in FIGS. 3 and 4, the desk 186 may be pulled out from the console, rotated 90 degrees, and positioned against the console 190 perpendicular to the console. In this manner, both sides of the desk 186 are exposed, permitting two chairs to be positioned on opposite sides of the desk, as shown in FIG. 3. In this configuration, the desk 186 may be used as a dining table.

The console 190 also provides flexibility and in that a guest may watch the television 200 in the bed 150 or while in the living zone. For example, for the left room 122, the television 200 can be rotated to face a guest sitting at the desk 186, lying on the bed 150, or sitting in the sofa 164. Similarly, the television 200 can be rotated in the right room 124 to face a guest at the desk 186, lying on the bed 152, or sitting in the sofa 166. The position of the television at the center of the room and the ability of the television to rotate provides a lot of flexibility in television viewing options for a guest.

Thus, the desk and console 156, 158 provide multiple functions for a hotel room guest, including viewing of a television, eating, working at a desk, and other functions. As described above, if desired, the console 190 may be integrated into or positioned adjacent to the foot of the bed. In addition, in embodiments, the console 190 may be positioned in other places within a room. However, by centrally locating the console 190 at the foot of the bed, the television is viewable from most places in the room, and the desk 186 can be comfortably used as a table.

Figure 7:
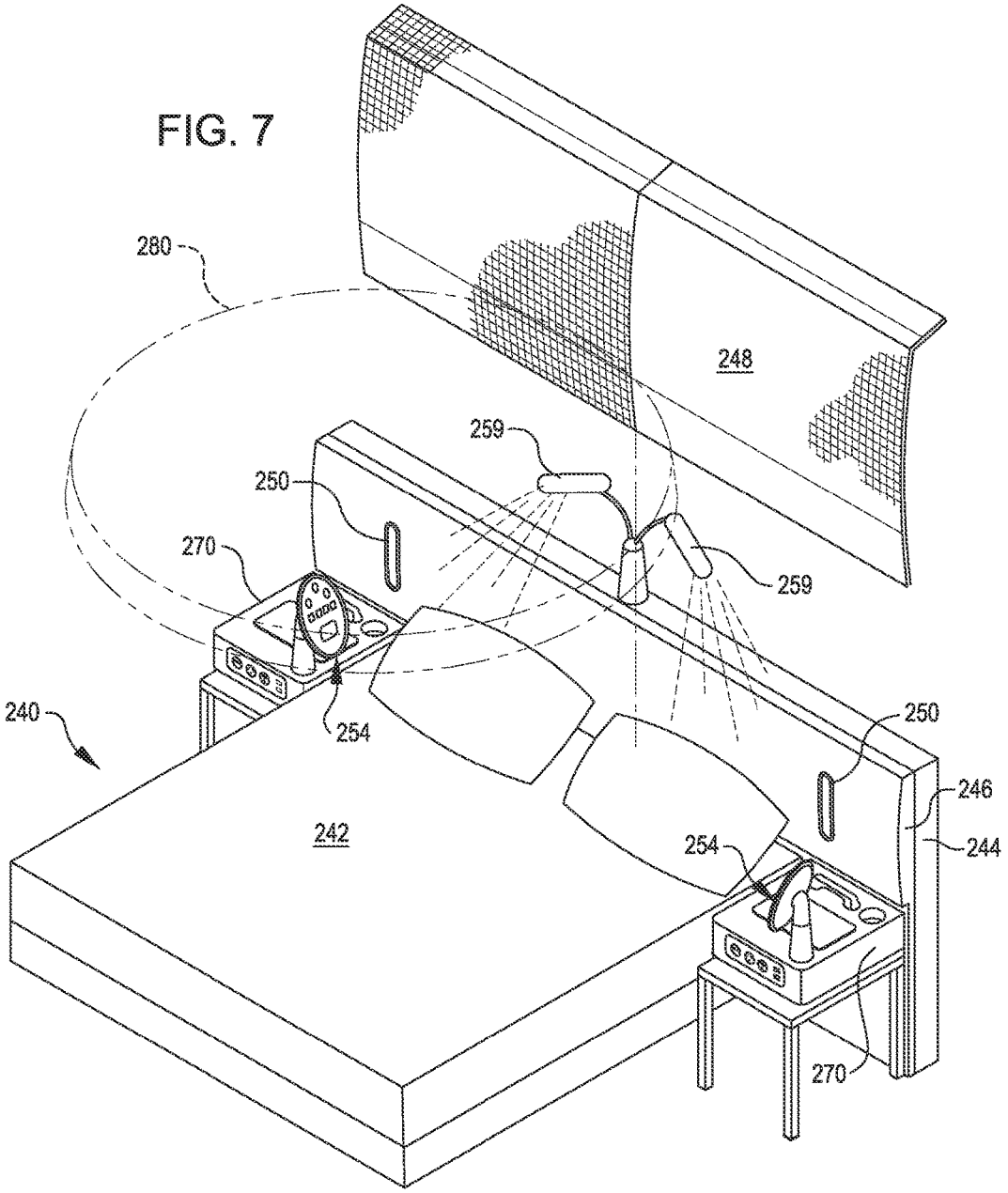
FIG. 7 is a side perspective view of a sleeping area incorporating various embodiments.

In accordance with additional embodiments, as shown in FIG. 7, a unique sleeping area 240 can be provided for a hotel room, such as the hotel room 124. The sleeping area includes features for enhancing sleep for a guest in a bed 242 and/or for aiding a guest to sleep while another guest in the room is not sleeping.

As an example, the bed 242 includes a headboard 244 having a sound-absorbing cushion 246 built into a headboard. The cushion 246 may include any type of passive structure that is capable of absorbing sound, including foam, foam rubber, or other suitable materials. In addition, cells or other structures may be provided for capturing sound and limiting sound that is transmitted by or transmitted to a guest in the bed 242.

In addition to being sound absorbing, the cushion 246 may be comfortable so that a guest may lean against it while sitting in bed. In such an embodiment, a cover 248 may be provided that is removable and washable, so that the headboard may be cleaned for different guests.

In accordance with embodiments, the headboard 244 additionally includes speakers 250 for audio output and/or for providing an active noise-cancelling function. The noise-cancelling function may be provided, for example, utilizing active noise cancellation technology known in the art.

Thus, in accordance with embodiments, the headboard 244 includes both active and passive sound absorbing or noise suppression technologies. For passive technologies, any acoustic panel may be used, including sound proofing foams or other structures as described above. For active noise reduction, opposite sound waves may be provided by a chip, microphone and speaker combination, such as is provided by Silentium, Ltd. in Rehovot, Israel, or such as is used Bose Corporation noise-cancelling headphones. In embodiments, the speakers 250 may be controlled separately, so that noise-cancelling may be provided on one side of the bed and not the other. In this manner, one guest, on one side of the bed, may utilize noise suppression while a second guest on the other side of the bed is reading, watching TV, or working.

Figure 8:
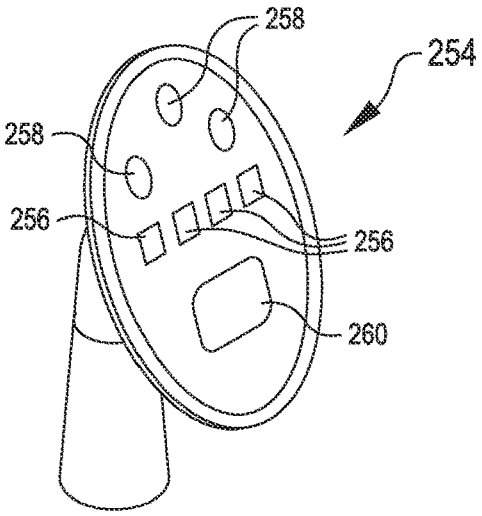
FIG. 8 is a side perspective view of a control panel for the sleeping area of FIG. 7 in accordance with embodiments.
Figure 9:
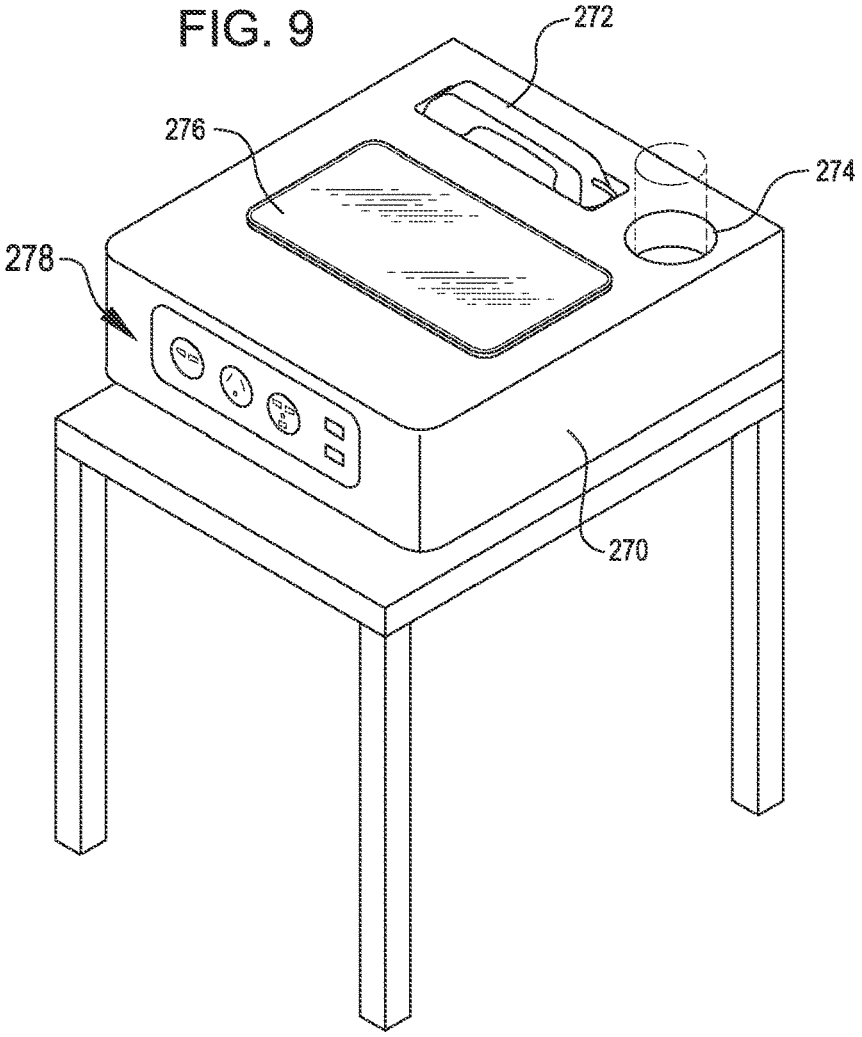
FIG. 9 is a side perspective view of a control center for the sleeping area of FIG. 7 in accordance with embodiments.

To provide control of functions for separate sides of the bed 242, a control panel 254 may be provided on each side of the bed. The control panel 254, shown in more detail in FIG. 8, may include buttons or dials 256 and displays 258 for controlling and displaying status of, respectively, a number of different functions provided in the sleeping area 240. One of these functions may be, for example, the individual speakers 250 on opposite sides of the headboard 244. Another function may be, for example, control of lights 259 that are directed to opposite sides of the bed 242. These lights may be unidirectional lights, so that they light only one side of the bed.

In addition, in accordance with embodiments, the control panel 254 may be provided with a vent 260, such that a user may individually control a temperature zone adjacent to his or her side of the bed. In this manner, one side of the bed may be cooler than the other. As an alternative to the vent 260 in the control panel 254, a vent may be provided in a different location, such as in the headboard 244. In embodiments, such a vent is positioned in the opening for the speakers 250. Thus, this opening serves to provide sound and cooling or heating.

A control panel 254 may be used alone, or may be mounted on a control center 270, as shown in FIG. 7. The control center includes an integrated phone 272. A glass holder 274 is provided for avoiding tipping or spilling of a liquid. A soft surface 276 is provided that may be used for, for example, positioning a phone or other valuables. This soft surface 276 may include inductive charging.

A front portion of the control center 270 includes a variety of charging sockets, which may be USB, international sockets, or other charging configurations. A radio or radio alarm clock may also be provided either in the control panel 254 or in the control center 270.

To provide better sleeping, a lower light fixture 280 may be utilized that extends suspended from the ceiling in the room and closer to the bed. This lower light fixture may provide an artificial skylight mobile and may provide several different lighting features including jet lag adjustment (low-light level at night) lighting, sunset (slowing dimming) mode, wakeup (slowly brightening) mode, and other modes. In embodiments, the light may dim automatically over time in a sunset sequence so as to aid a user in falling to sleep. Similarly, a reverse process may be provided in a wakeup sequence where the light goes from off to dimmed lighting and to a brighter setting. In addition, in embodiments, a curtain (not shown) may be provided for surrounding the bed and capturing and maintaining light projected by the light fixture 280. This light curtain may provide a separation of the lighted or dark area for the bed 282 and other areas of the room.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A method of retrofitting a hotel, the hotel comprising a pair of structural walls with a space including two original rooms defined between the structural walls, and a dividing wall separating the two original rooms, the method comprising:

removing the dividing wall; and replacing the dividing wall with a structure that separates the space into two new rooms and defines separate alcoves in each of the two new rooms, wherein, the two new rooms are shaped like a T and L, respectively;

wherein the structure defines a first alcove including a first portion that adds space to the first new room compared to a first original room and takes away space from the second new room compared to a second original room, and a second alcove including a second portion that adds space to the second new room compared to the second original room and takes space away from the first new room compared to the first original room ; and wherein the first alcove and the second alcove are each sized and configured to fully contain at least one of a bed, fold-out bed, recliner, or sofa.

2. The method of claim 1, wherein the dividing wall comprises a straight wall.

3. The method of claim 2, wherein the structure is an S shaped wall.

4. The method of claim 1, wherein the structure is an S shaped wall.

5. A hotel comprising:

a first structural wall;

a second structural wall;

a space defined between the first and second structural walls; and a dividing wall with a structure that separates the space into two rooms and defines separate alcoves in each of the two rooms, wherein the two rooms are shaped like an L and a T, respectively, wherein the two rooms include a first room and a second room, and the dividing wall includes a first portion that separates the alcove of the first room from the second room, a second portion that separates the alcove of the second room from the first room, and a middle portion that separates the separate alcoves from each other, the middle portion having a segment that runs substantially perpendicular to the first and second portions, and wherein, at least one of the alcoves is sized to accommodate at least one of a desk, a bed or a couch.

6. The hotel of claim 5, wherein the L-shaped room includes a sitting area at the lower portion of the L, and a sleeping portion in the main part of the L.

7. The hotel of claim 6, wherein the T-shaped room includes a sitting area in the base of the T, and a sleeping area in one of the arms of the T.

8. The hotel of claim 5, wherein the structure is an S shaped wall.

9. The hotel of claim 5, further comprising:

a bed in at least one of the rooms; and a console at a foot of the bed, the console comprising a rotating television stand that is viewable from the bed and from the separate spaces in the rooms.

10. The hotel of claim 9, further comprising a desk that is configurable between a first configuration that the desk extends parallel to the console and a second configuration in which the desk is perpendicular to the console and can be used as a table so that chairs can be positioned on opposite sides of the desk.

11. The hotel of claim 5, wherein the alcove of the first room and the alcove of the second room are each sized and configured to fully contain at least one of a desk, a bed or a couch.

12. The hotel of claim 5, further comprising a partition element aligned with the first portion of the dividing wall, the partition element being configured to obstruct a line of sight between the first room and the alcove of the first room.

13. A method of retrofitting a hotel, the hotel comprising a pair of structural walls with a space including a first original room and a second original room defined between the structural walls, and a dividing wall separating the first and second original rooms, the method comprising:

removing the dividing wall; and replacing the dividing wall with a structure that separates the space into a first new room and a second new room and defines first and second separate spaces in the first and second new rooms, respectively, wherein the structure includes an S shaped wall including at least a first portion, a second portion and a third portion, the first and third portions being substantially parallel, and wherein the first portion and the third portion are offset by the second portion in a direction perpendicular to the first and third portions, said offset having a depth at least sized to accommodate one or more of a bed, fold-out bed, recliner, or sofa.

14. The hotel of claim 13, wherein the second portion is substantially perpendicular to the first and third portions.

15. The method of claim 13, further comprising:

installing a partition element aligned with the first portion, wherein the partition element subdivides the first new room from the first separate space.

* * * * *